US010411409B2

(12) United States Patent
Hashim et al.

(10) Patent No.: US 10,411,409 B2
(45) Date of Patent: Sep. 10, 2019

(54) BALANCED PIN AND SOCKET CONNECTORS

(71) Applicant: CommScope, Inc. of North Carolina, Hickory, NC (US)

(72) Inventors: Amid I. Hashim, Plano, TX (US); Richard Y. Mei, Parker, TX (US); Golam M. Choudhury, Warren, NJ (US)

(73) Assignee: COMMSCOPE, INC. OF NORTH CAROLINA, Hickory, NC (US)

( * ) Notice: Subject to any disclaimer, the term of this patent is extended or adjusted under 35 U.S.C. 154(b) by 0 days.

(21) Appl. No.: 15/978,350

(22) Filed: May 14, 2018

(65) Prior Publication Data

US 2019/0140399 A1 May 9, 2019

Related U.S. Application Data

(63) Continuation of application No. 15/206,630, filed on Jul. 11, 2016, now Pat. No. 9,972,940, which is a (Continued)

(51) Int. Cl.
*H01R 13/64* (2006.01)
*H01R 13/6467* (2011.01)
(Continued)

(52) U.S. Cl.
CPC ..... *H01R 13/6467* (2013.01); *H01R 13/6461* (2013.01); *H01R 13/6463* (2013.01); *H01R 13/6471* (2013.01)

(58) Field of Classification Search
CPC ..... H01R 13/6467
See application file for complete search history.

(56) References Cited

U.S. PATENT DOCUMENTS 4,072,390 A 2/1978 Fox
RE33,005 E * 8/1989 Bryce ..... H01R 12/58 439/78

(Continued)

FOREIGN PATENT DOCUMENTS

CN 101208833 A 6/2008
EP 0 880 202 A2 11/1998

(Continued)

OTHER PUBLICATIONS

Office Action in European Application No. 13740483.6, dated Nov. 16, 2018, 4 pages.

(Continued)

*Primary Examiner* — James Harvey
(74) *Attorney, Agent, or Firm* — Merchant & Gould P.C.

(57) ABSTRACT

Communications connectors include a housing and a plurality of substantially rigid conductive pins that are mounted in the housing. The conductive pins are arranged as a plurality of differential pairs of conductive pins that each include a tip conductive pin and a ring conductive pin. Each conductive pin has a first end that is configured to be received within a respective socket of a mating connector and a second end. The tip conductive pin of each differential pair of conductive pins crosses over its associated ring conductive pin to form a plurality of tip-ring crossover locations.

20 Claims, 13 Drawing Sheets

Related U.S. Application Data continuation of application No. 13/942,881, filed on Jul. 16, 2013, now Pat. No. 9,407,043.

(60) Provisional application No. 61/672,069, filed on Jul. 16, 2012, provisional application No. 61/730,628, filed on Nov. 28, 2012.

(51) Int. Cl.

| | |
|---|---|
| ***H01R 13/6461*** | (2011.01) |
| ***H01R 13/6463*** | (2011.01) |
| *H01R 13/6471* | (2011.01) |

(56) References Cited

U.S. PATENT DOCUMENTS

| | | | | |
|---|---|---|---|---|
| 5,226,835 | A * | 7/1993 | Baker, III | H01R 13/6467 439/403 |
| 5,362,257 | A | 11/1994 | Neal et al. | |
| 5,490,797 | A * | 2/1996 | Durgin | H01R 13/2421 439/310 |
| 5,509,814 | A * | 4/1996 | Mosquera | H01R 12/58 439/78 |
| 5,635,775 | A * | 6/1997 | Colburn | H05K 1/0231 307/91 |
| 5,727,963 | A * | 3/1998 | LeMaster | A47C 11/02 439/358 |
| 5,911,594 | A * | 6/1999 | Baker, III | H01R 13/6463 439/404 |
| 5,915,989 | A | 6/1999 | Adriaenssens et al. | |
| 6,065,994 | A | 5/2000 | Hashim et al. | |
| 6,107,578 | A | 8/2000 | Hashim | |
| 6,196,880 | B1 | 3/2001 | Goodrich et al. | |
| 6,270,381 | B1 | 8/2001 | Adriaenssens et al. | |
| 6,464,541 | B1 * | 10/2002 | Hashim | H01R 13/6466 439/620.11 |
| 7,223,115 | B2 | 5/2007 | Hashim et al. | |
| 7,503,798 | B2 | 3/2009 | Hashim | |
| 9,407,043 | B2 | 8/2016 | Hashim et al. | |
| 9,972,940 | B2 | 5/2018 | Hashim et al. | |
| 2007/0173103 | A1 * | 7/2007 | Ellis | H01R 13/6464 439/404 |
| 2007/0184725 | A1 | 8/2007 | Hashim | |
| 2007/0212946 | A1 | 9/2007 | Bert | |
| 2010/0035454 | A1 * | 2/2010 | Morgan | H01R 13/6467 439/296 |
| 2014/0017956 | A1 | 1/2014 | Hashim et al. | |
| 2014/0335732 | A1 | 11/2014 | Oberski et al. | |
| 2014/0335738 | A1 | 11/2014 | Chen | |
| 2016/0141807 | A1 * | 5/2016 | Gailus et al. | H01R 12/7076 439/607.05 |
| 2016/0322752 | A1 | 11/2016 | Hashim et al. | |
| 2017/0133778 | A1 * | 5/2017 | Oberski | H01R 13/6467 |

FOREIGN PATENT DOCUMENTS

| | | | |
|---|---|---|---|
| EP | 1 087 472 | A1 | 3/2001 |
| WO | 2006/132972 | A1 | 12/2006 |
| WO | 2012/087956 | A2 | 6/2012 |

OTHER PUBLICATIONS

Chinese First Office Action Corresponding to Chinese Application No. 201380036013.8; dated Jul. 14, 2016; Foreign Text, 7 Pages, English Translation, 9 Pages.

Invitation to Pay Additional Fees Corresponding to International Application No. PCT/US2013/050613; dated Sep. 27, 2013; 6 Pages.

International Preliminary Report on Patentability Corresponding to International Application No. PCT/US2013/050613; dated Jan. 29, 2015; 11 Pages.

International Search Report and Written Opinion, Corresponding to International Application No. PCT/US2013/050613; dated May 21, 2014; 16 Pag.

Supplementary European Search Report, corresponding to European Application No. 13740483.6, dated Aug. 25, 2017, 7 pp.

* cited by examiner

BALANCED PIN AND SOCKET CONNECTORS

CROSS-REFERENCE TO RELATED APPLICATIONS

This application is a continuation of application Ser. No. 15/206,630, filed Jul. 11, 2016, now U.S. Pat. No. 9,972,940, which is a continuation of application Ser. No. 13/942,881, filed Jul. 16, 2013, now U.S. Pat. No. 9,407,043, which application claims the benefit of provisional application Ser. No. 61/672,069, filed Jul. 16, 2012 and provisional application Ser. No. 61/730,628, filed Nov. 28, 2012, which applications are incorporated herein by reference in their entirety.

FIELD OF THE INVENTION

The present invention relates generally to communications connectors and, more particularly, to pin connectors and socket connectors which can be mated together.

BACKGROUND

Pin connectors and socket connectors are known types of communications connectors that may be used, for example, to detachably connect two communications cables and/or to connect a communications cable to a printed circuit board or an electronic device. Pin and socket connectors are used in a variety of applications such as, for example, in automobiles and in data centers.

FIG. 1 is a perspective view of an example of a conventional pin connector 10. As shown in FIG. 1, the pin connector 10 includes a housing 20 that has a plug aperture 22. The plug aperture 22 may be sized and configured to receive a mating socket connector. The pin connector 10 further includes a conductive pin array 24 that includes eighteen conductive pins 30 that are mounted in the housing 20. Each conductive pin 30 has a first end 32 that extends into the plug aperture 22 and a second end 36 that extends downwardly from a bottom surface of the housing 20. The first end 32 of each conductive pin 30 may be received within a respective socket of a mating socket connector that is inserted into the plug aperture 22, and the second end 36 of each conductive pin 30 may be inserted into, for example, a printed circuit board (not shown).

FIG. 2 is a perspective view of conductive pins 30-1 through 30-8 that are included in the conductive pin array 24 of pin connector 10 of FIG. 1. Herein, when a device such as a connector includes multiple of the same components, these components are referred to individually by their full reference numerals (e.g., conductive pin 30-4) and are referred to collectively by the first part of their reference numeral (e.g., the conductive pins 30). Only eight of the eighteen conductive pins 30 that are included in pin connector 10 of FIG. 1 are illustrated in FIG. 2 in order to simplify the drawing and the explanation thereof. As shown in FIG. 2, a middle portion 34 of each conductive pin 30 that connects the first end 32 to the second end 36 includes a right angled section 38. The first ends 32 of the conductive pins 30 extend along the x-direction (see the reference axes in FIG. 2) and are aligned in two rows. The second ends 36 of the conductive pins 30 extend along the z-direction and are also aligned in two rows. It will be appreciated that the remaining ten conductive pins 30 of pin connector 10 that are not pictured in FIG. 2 are aligned in the same two rows and that the conductive pins 30 in each row all have the exact same design and spacing from adjacent conductive pins 30.

FIGS. 3 and 4 are perspective views of a partially disassembled socket connector 50 that may be used in conjunction with the pin connector 10 of FIG. 1. As shown in FIGS. 3 and 4, the socket connector 50 includes a housing 60 that includes a plurality of pin apertures 62. The housing 60 defines an open interior 64 that receives a socket contact holder 70. The housing 60 includes a side opening 66 that provides an access opening for inserting the socket contact holder 70 within the open interior 64. The side opening 66 also provides an access opening for the conductors of a communications cable (not shown) to be routed into the open interior 64 for termination within the socket contact holder 70. A locking member 68 is mounted on an exterior surface of the housing 60. The socket connector 50 may be received within the plug aperture 22 of the pin connector 10 so that each of the conductive pins 30 of the pin connector is received within a respective pin aperture 62 of housing 60. The locking member 68 may be used to lock the socket connector 50 within the plug aperture 22 of the pin connector 10.

FIG. 5 is a perspective view the socket contact holder 70. FIG. 6 is a perspective view of a socket contact 80. As shown in FIG. 5, the socket contact holder 70 includes a plurality of sockets 76 that extend from a front face 74 to the rear face 72 of the socket contact holder 70. Each socket 76 is sized to receive a respective one of the socket contacts 80. Accordingly, a socket contact array 78 that includes a plurality of socket contacts 80 may be populated into the sockets 76 in socket contact holder 70. Each socket contact 80 includes a front end 82 and a rear end 84. The front end 82 is configured to receive and grasp a conductive pin of a mating pin connector (e.g., one of the conductive pins 30 of pin connector 10) that is received through a respective one of the pin apertures 62 in housing 60. The front end 82 may include a spring mechanism (not visible in FIG. 6) that biases a conductive component of the socket contact 80 against the conductive pin 30 of the mating pin connector 10 that is received therein in order to maintain a good mechanical and electrical contact between the conductive pin 30 and the socket contact 80. The rear end 84 of the socket contact 80 may be configured to receive a conductor of a communications cable (not shown) such as a copper wire by means of a crimped connection. Thus, each socket contact 80 may be used to electrically connect a conductive pin of a pin connector to a conductor of a communications cable.

SUMMARY

Pursuant to embodiments of the present invention, communications connectors are provided that include a housing and a plurality of substantially rigid conductive pins that are mounted in the housing, the conductive pins arranged as a plurality of differential pairs of conductive pins that each include a tip conductive pin and a ring conductive pin. Each conductive pin has a first end that is configured to be received within a respective socket of a mating connector and a second end. The tip conductive pin of each differential pair of conductive pins crosses over its associated ring conductive pin to form a plurality of tip-ring crossover locations.

Pursuant to additional embodiments of the present invention, communications connectors are provided that include a housing and a plurality of substantially rigid conductive pins that are mounted in the housing, the conductive pins arranged as a plurality of differential pairs of conductive pins. Each of the conductive pins has a first end, a second end and middle section wherein the first and second end are each staggered with respect to the middle section so that a first end of a second conductive pin of a first of the differential pairs of conductive pins is substantially aligned with a first end of a first conductive pin of a second of the differential pairs and a second end of a first conductive pin of the first of the differential pairs of conductive pins is substantially aligned with a second end of a second conductive pin of the second of the differential pairs. The differential pairs of conductive pins are routed so that differential-to-differential crosstalk is substantially cancelled between adjacent ones of the differential pairs of conductive pins. Moreover, the first ends of the conductive pins are arranged to mate with the respective sockets of a mating connector.

Pursuant to still further embodiments of the present invention, communications connectors are provided that include a housing and a plurality of contacts that are mounted in the housing, the contacts arranged as a plurality of differential pairs of contacts that each include a tip contact and a ring contact. The plurality of contacts comprises a plurality of sockets that each have a first end that is configured to receive a respective one of a plurality of conductive pins. The tip contact of each differential pair of contacts crosses over its associated ring contact to form a plurality of tip-ring crossover locations.

Pursuant to still further embodiments of the present invention, communications connector systems are provided that include a plurality of housings, where each housing has at least one pair of conductive pins mounted therein. Each of the pairs of conductive pins is arranged as a differential pair of conductive pins that includes a tip conductive pin and a ring conductive pin. Each conductive pin has a first end that is configured to be received within a respective socket of a mating connector and a second end. The tip conductive pin of each pair of conductive pins crosses over its associated ring conductive pin to form a tip-ring crossover location.

Pursuant to still other embodiments of the present invention, cabling systems for a vehicle are provided that include a first cable having a first twisted pair of conductors, a second cable having a second twisted pair of conductors, and a ruggedized connection hub electrically connecting the first twisted pair of conductors to the second twisted pair of conductors.

DETAILED DESCRIPTION

Figure 1:
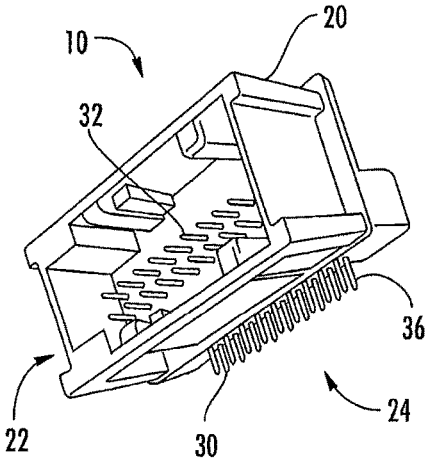
FIG. 1 (PRIOR ART)
FIG. 1 is a perspective view of a conventional pin connector.

Pursuant to embodiments of the present invention, pin connectors and socket connectors are provided that can be used as mated pin and socket connectors that are well balanced and can operate within the performance characteristics set forth in the Category 6A standard for Ethernet connectors (e.g., the ANSI/TIA-568-C.2 standard approved Aug. 11, 2009). The pin and socket connectors according to embodiments of the present invention may be used to connect a plurality of conductors of a communications cable to, for example, a second cable or a printed circuit board. The connectors may be designed to transmit a plurality of differential signals. The connector designs according to embodiments of the present invention may be readily expanded to accommodate any number of differential pairs. Moreover, the connectors according to embodiments of the present invention employ self-compensation techniques that may significantly reduce the amount of differential-to-differential crosstalk and/or differential-to-common mode crosstalk that arises within the connectors. The connectors according to embodiments of the present invention may be used, for example, as connectors in automobiles.

As noted above, the communications connectors according to embodiments of the present invention may use differential signaling techniques. Differential signaling refers to a communications scheme in which an information signal is transmitted over a pair of conductors (hereinafter a "differential pair" or simply a "pair") rather than over a single conductor. The signals transmitted on each conductor of the differential pair have equal magnitudes, but opposite phases, and the information signal is embedded as the voltage difference between the signals carried on the two conductors of the pair. When a signal is transmitted over a conductor, electrical noise from external sources may be picked up by the conductor, degrading the quality of that signal. When the signal is transmitted over a differential pair of conductors, each conductor in the differential pair often picks up approximately the same amount of noise from these external sources. Because approximately an equal amount of noise is added to the signals carried by both conductors of the differential pair, the information signal is typically not disturbed, as the information signal is extracted by taking the difference of the signals carried on the two conductors of the differential pair; thus, the noise signal is cancelled out by the subtraction process. While differential signals most typically are centered about zero (i.e., the instantaneous voltage on one conductor will be −X when the instantaneous voltage on the other conductor of the pair is X), in some embodiments the differential signals may be centered about a positive or negative voltage (e.g., if the instantaneous voltage on one conductor will be −X+2, then the instantaneous voltage on the other conductor of the pair will be X+2 such that the differential signal is centered about a common mode voltage of 2 volts).

The conventional pin and socket connectors discussed in the Background section above are generally not used for differential transmission. As such, these conventional pin and socket connectors may exhibit relatively poor performance due to signal degradation from external noise sources. Additionally, the conventional pin and socket connectors may also be particularly susceptible to another type of noise known as "crosstalk." As is known to those of skill in this art, "crosstalk" refers to unwanted signal energy that is induced by capacitive and/or inductive coupling onto the conductors of a first "victim" communications channel from a signal that is transmitted over a second "disturbing" communications channel that is in close proximity. When a communications connector includes multiple communications channels such as the conventional pin and socket connectors discussed in the Background section above, crosstalk may arise between the channels within the communications connector that may limit the data rates that may be supported on each channel. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different channel), and far-end crosstalk (FEXT), which is the crosstalk measured at the output location corresponding to a source at the input location (i.e., crosstalk whose signal travels in the same direction as the disturbing signal in the different channel). Both types of crosstalk comprise undesirable noise signals that interfere with the information signal on the victim communications channel.

Figure 7:
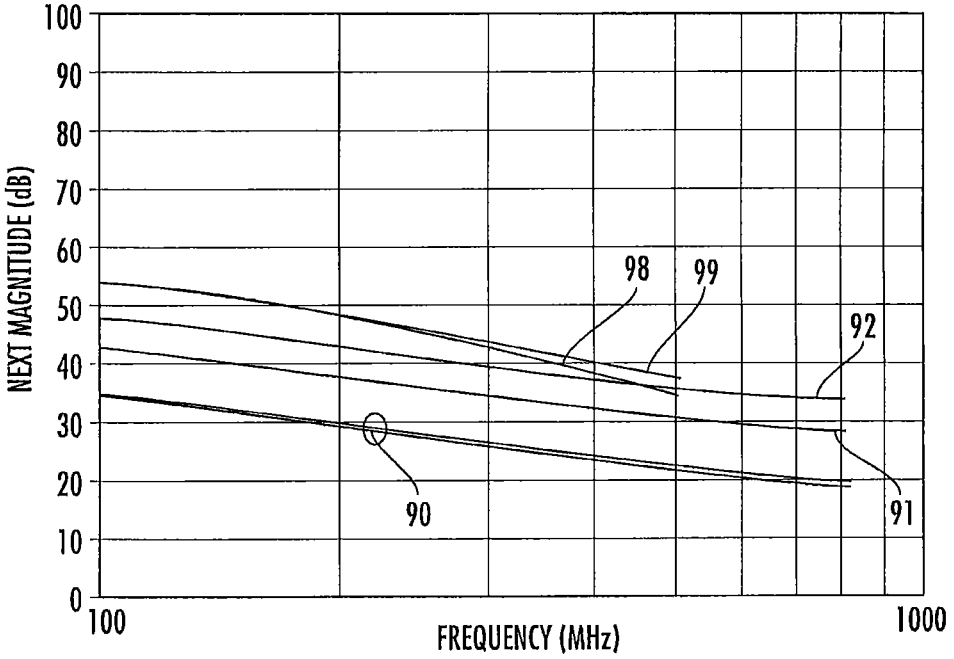
FIG. 7 (PRIOR ART)
FIG. 7 is a graph illustrating the simulated near-end crosstalk of the pin connector of FIGS. 1-2 in the forward direction.

Even if the conventional pin and socket connectors discussed above are used to transmit differential signals, they may still exhibit relatively poor performance. For example, FIG. 7 is a graph illustrating the simulated near-end crosstalk in the "forward" direction of the pin connector of FIGS. 1-2 for the eight conductive pins 30-1 through 30-8 illustrated in FIG. 2). For purposes of this simulation, pins 30-1 and 30-2 were used as a first differential pair 41, pins 30-3 and 30-4 were used as a second differential pair 42, pins 30-5 and 30-6 were used as a third differential pair 43, and pins 30-7 and 30-8 were used as a fourth differential pair 44. Herein a signal is travelling in the "forward" direction along a conductive pin 30 when it flows from the first end 32 of the conductive pin 30 to the second end 36 of the conductive pin 30.

Because of the unbalanced arrangement of pins 30-1 through 30-8 (i.e., conductive pin 30-3 of pair 42 is always closer to conductive pin 30-1 of pair 41 than it is to conductive pin 30-2 of pair 41, and conductive pin 30-4 of pair 42 is always closer to conductive pin 30-2 of pair 41 than it is to conductive pin 30-1 of pair 41), significant crosstalk may arise between adjacent differential pairs and even between non-adjacent differential pairs (e.g., pairs 41 and 43). Thus, the pin connector 10 may exhibit poor crosstalk performance due to differential-to-differential crosstalk between the pairs. This can be seen, for example, in the graph of FIG. 7 which illustrates the near-end crosstalk performance for each of the pair combinations in the forward direction. Curve group 90 in FIG. 7, which is a cluster of three almost identical curves, illustrates the near-end crosstalk performance for directly adjacent differential pairs (namely the crosstalk induced on pair 42 when a signal is transmitted over pair 41 and vice versa, the crosstalk induced on pair 43 when a signal is transmitted over pair 42 and vice versa, and the crosstalk induced on pair 44 when a signal is transmitted over pair 43 and vice versa). As shown by curve group 90 in FIG. 7, the near end crosstalk on adjacent pairs is at least 12 dB worse than the level of crosstalk allowed under the TIA and ISO Category 6A standards (which are illustrated by curves 98 and 99, respectively, in FIG. 7), and hence the pin connector 10 will clearly support far lower data rates than a Category 6A compliant connector.

Likewise, curve group 91 in FIG. 7, which is a cluster of two almost identical curves, illustrates the near-end crosstalk performance for "one-over" pair combinations in the connector 10 (a "one-over" pair combination refers to a combination of two differential pairs that have one additional differential pair located therebetween). In the connector 10, the "one-over" pair combinations are pairs 41 and 43 and pairs 42 and 44. As shown in FIG. 7, the near-end crosstalk on the one-over pair combinations is about 8 dB worse than the level of crosstalk allowed under the TIA and ISO Category 6A standards. Finally, curve 92 in FIG. 7 illustrates the near-end crosstalk performance for "two-over" pair combinations in the connector 10 (a "two-over" pair refers to a combination of two differential pairs that have two additional differential pairs located therebetween). In the connector 10, the only two-over pair combination is pairs 41 and 44. As shown in FIG. 7, the near end crosstalk on the two-over pair combination is still worse than the level of crosstalk allowed under the TIA and ISO Category 6A standards for all frequencies below about 450 MHz.

The pin and socket communications connectors according to embodiments of the present invention may provide significant performance improvement as compared to the conventional pin and socket connectors discussed above. Embodiments of the present invention will now be described with reference to the accompanying drawings, in which exemplary embodiments are shown.

Figure 8:
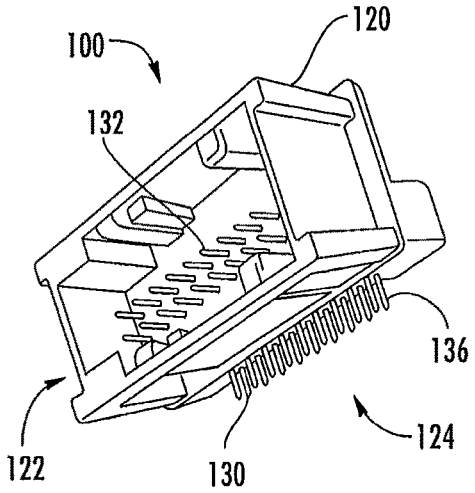
FIG. 8 is a perspective view of a pin connector according to embodiments of the present invention.

FIG. 8 is a perspective view of a pin connector 100 according to embodiments of the present invention. As shown in FIG. 8, the pin connector 100 includes a housing 120 that has a plug aperture 122. The plug aperture 122 may be sized and configured to receive a mating socket connector. The pin connector 100 includes a conductive pin array 124 that has eighteen conductive pins 130. Each of the conductive pins 130 is mounted in the housing 120. These conductive pins 130 may be arranged as nine differential pairs of conductive pins 130.

Figure 9A:
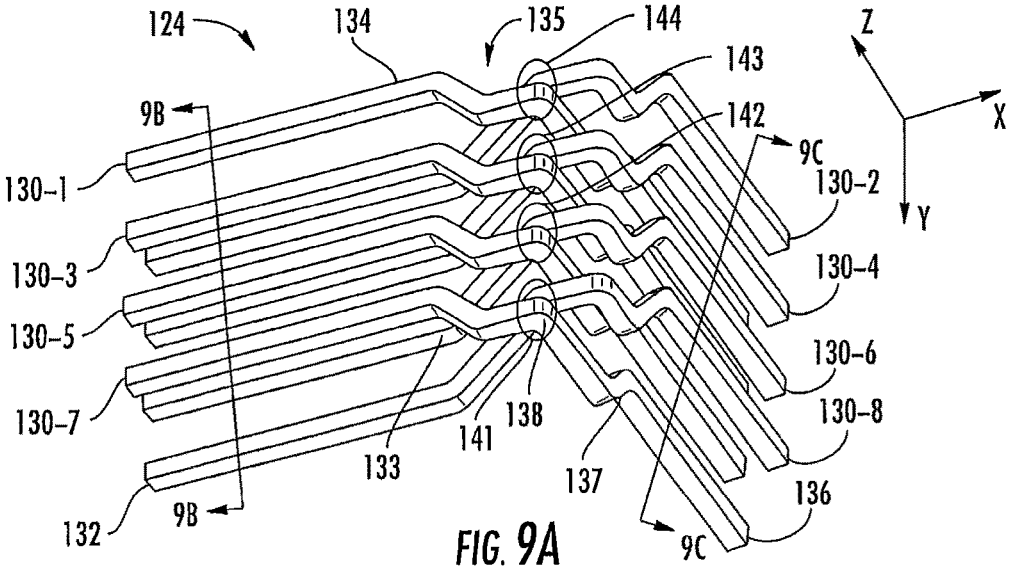
FIG. 9A is a schematic perspective view of eight pins of a conductive pin array that is included in the pin connector of FIG. 8.
Figure 9B:
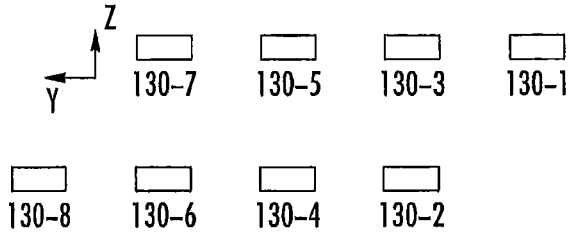
FIG. 9B is a cross-sectional view taken along the line 9B-9B of FIG. 9A.
Figure 9C:
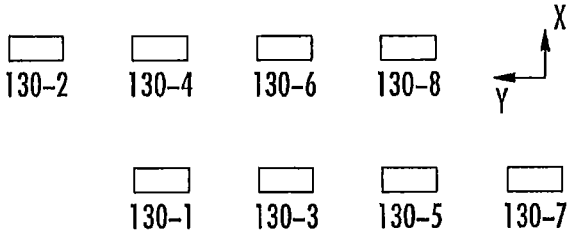
FIG. 9C is a cross-sectional view taken along the line 9C-9C of FIG. 9A.
Figure 9D:
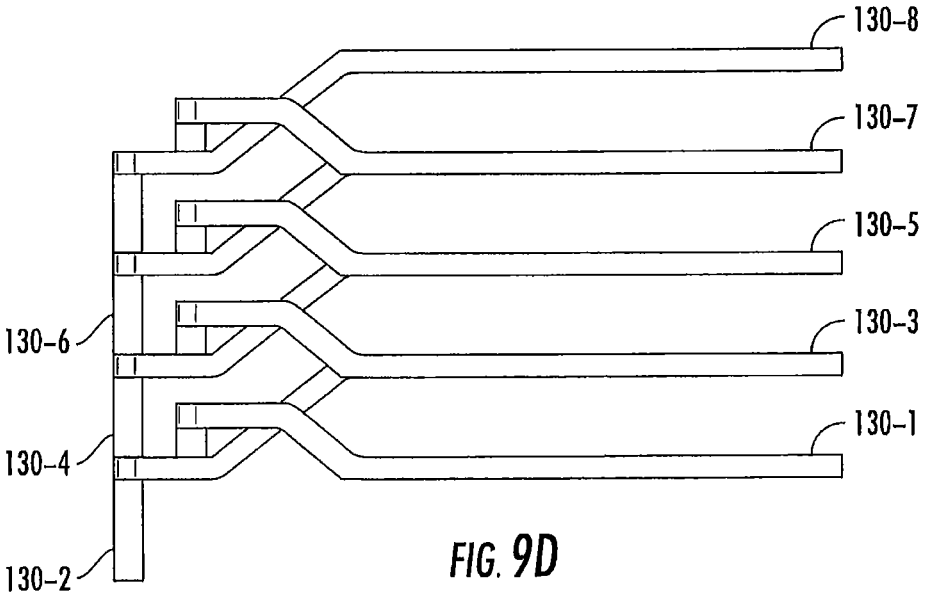
FIG. 9D is a top view of the conductive pin array of FIG. 9A.

FIG. 9A is a schematic perspective view of eight of the conductive pins (namely conductive pins 130-1 through 130-8) that are included in the conductive pin array 124 of the pin connector 100 of FIG. 8. FIG. 9B is a cross-sectional view taken along the line 9B-9B of FIG. 9A, and FIG. 9C is a cross-sectional view taken along the line 9C-9C of FIG. 9A. Finally, FIG. 9D is a top view of the conductive pins 130 that more clearly shows crossovers that are included in each differential pair of conductive pins 130.

As shown in FIG. 9A, pins 130-1 and 130-2 form a first differential pair 141, pins 130-3 and 130-4 form a second differential pair 142, pins 130-5 and 130-6 form a third differential pair 143, and pins 130-7 and 130-8 form a fourth differential pair 144. As known to those of skill in the art, the positive conductor of a differential pair is referred to as the "tip" conductor and the negative conductor of a differential pair is referred to as the "ring" conductor. In some embodiments, conductive pins 130-1, 130-3, 130-5 and 130-7 may be the tip conductive pins and conductive pins 130-2, 130-4, 130-6 and 130-8 may be the ring conductive pins of the four differential pairs 141-144.

As is further shown in FIGS. 9A-9D, each conductive pin 130 includes a first end 132, a middle portion 134, and a second end 136. The first end 132 of each conductive pin 130 generally extends along the x-direction. The second end 136 of each conductive pin 130 generally extends along the z-direction. The middle portion 134 of each conductive pin 130 includes a right angled section 138 that provides the transition from the x-direction to the z-direction. Additionally, each conductive pin 130 further includes two jogged sections that are provided so that the first conductive pin 130 of each differential pair of conductive pins 130 crosses over the second conductive pin 130 of the differential pair at a crossover location 135. The provision of these crossovers may allow the pin connectors 100 according to embodiments of the present invention to achieve substantially improved electrical performance.

As shown in FIG. 9A, the two jogged sections that are provided on each conductive pin 130 comprise a first transition section 133 and a second transition section 137. The first transition section 133 is provided on each of the conductive pins 130 between the first end 132 thereof and the right-angled section 138. On each of the tip conductive pins 130-1, 130-3, 130-5, 130-7 the first transition section 133 causes the conductive pin to jog in the positive direction along the y-axis. In contrast, on each of the ring conductive pins 130-2, 130-4, 130-6, 130-8 the first transition section 133 causes the conductive pin to jog in the opposite (negative) direction along the y-axis. As a result of the opposed nature of these transition sections 133 on the tip and ring conductive pins 130 of each differential pair 141-144, the tip and ring conductive pins 130 cross over each other between their first ends 132 and the right-angled section 138. These crossovers may be clearly seen in FIGS. 9A and 9D. Note that the first transition sections 133 need not form a right angle with respect to the x-axis. Instead, as shown in FIG. 9A, the first transition sections 133 merely need to change the path of the conductive pin at issue from a first coordinate along the y-axis to a second (different) coordinate along the y-axis in order to effect the crossover.

The second transition section 137 that is provided on each of the conductive pins 130 is located between the second end 136 and the right-angled section 138. The second transition sections 137 cause jogs in the same direction on all eight of the conductive pins 130, namely in the negative direction along the y-axis. While in the embodiment of FIG. 9A the first transition sections 133 and the second transition sections 137 are implemented by bending each conductive pin 130 by about 45° at the beginning of the transition section and by bending the conductive pin 130 by about −45° at the end of the transition section, it will be appreciated that any angles may be used to implement the transition sections 133, 137. For example, in other embodiments, the transition sections 133, 137 may have angles of 60° and −60° or angles of 90° and −90°. In yet other embodiments, the transition sections 137 may be totally eliminated, since unlike the transition 133, the transition sections 137 do not implement crossovers.

As shown in FIGS. 9A and 9B, the first ends 132 of the conductive pins 130 are aligned in two rows, with the first ends of conductive pins 130-2 and 130-3 vertically aligned, the first ends of conductive pins 130-4 and 130-5 vertically aligned, and the first ends of conductive pins 130-6 and 130-7 vertically aligned. As shown in FIGS. 9A and 9C, the second ends 136 of the conductive pins 130 are similarly aligned in two rows, with the second ends of conductive pins 130-1 and 130-4 vertically aligned, the second ends of conductive pins 130-3 and 130-6 vertically aligned, and the second ends of conductive pins 130-5 and 130-8 vertically aligned. It will be appreciated, however, that the first and second ends 132, 136 of the various conductive pins 130 may not be vertically aligned in this fashion in other embodiments (e.g., they may only be generally vertically aligned).

The pin connectors according to embodiments of the present invention may exhibit significantly improved electrical performance as compared to the conventional pin connector 10 discussed above. As shown in FIGS. 9A-9D, because of the staggered contact arrangement at the two ends of the pin connector 100, different "unlike" conductive pins 130 of two adjacent ones of the differential pairs 141-144 (i.e., a tip conductive pin from one differential pair and a ring conductive pin from the adjacent differential pair) are vertically aligned at either end of the pin connector 100. By way of example, on the left-hand side of FIG. 9A, conductive pins 130-2 and 130-3 are vertically aligned, while conductive pins 130-1 and 130-4 are offset to either side of conductive pins 130-2 and 130-3. In contrast, on the right-hand side of FIG. 9A conductive pins 130-1 and 130-4 are vertically aligned, while conductive pins 130-2 and 130-3 are offset to either side of conductive pins 130-1 and 130-4. By using this staggered arrangement, and by controlling the lengths of the conductive pins 130, the distances between the conductive pins 130, the dielectric constant of the housing, etc., the pin connectors according to embodiments of the present invention may generate coupling between "unlike" conductive pins that substantially cancels the crosstalk between the "like" conductive pins of each set of adjacent differential pairs ("like" conductive pins refer to two or more of the same type of conductive pin, such as two tip conductive pins or two ring conductive pins). Thus, the conductive pin arrangements according to certain embodiments of the present invention may result in substantial self cancellation of any "offending" crosstalk that may otherwise arise at either the front end region or rear end region of the conductive pins 130.

Additionally, the same crosstalk compensation benefits may also be achieved with respect to crosstalk between non-adjacent pairs such as "one-over" combinations of differential pairs (e.g., pairs 141 and 143 in FIG. 9A), "two-over" combinations of differential pairs (e.g., pairs 141 and 144 in FIG. 9A), etc.

Moreover, the crosstalk compensation arrangement that is implemented in the conductive pin arrangement of FIGS. 9A-9D is "stackable" in that any number of additional differential pairs of conductive pins 130 can be added to the first and second rows. For example, while FIGS. 9A-9D illustrate a conductive pin arrangement in which eight conductive pins 130 are used to form four differential pairs, any number of differential pairs may be provided simply by adding additional conductive pins on either or both ends of rows.

Figure 10:
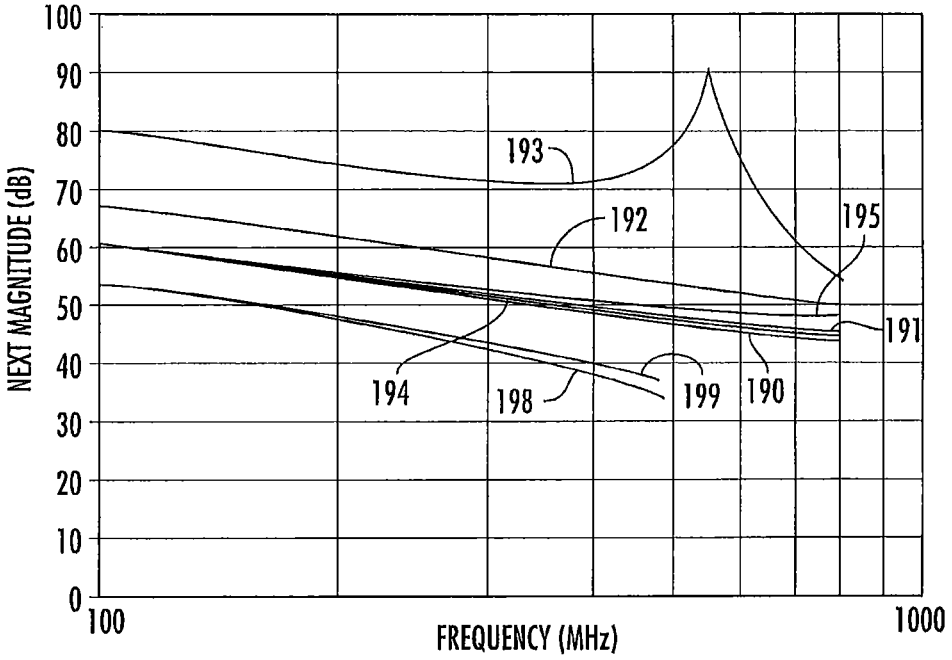
FIG. 10 is a graph illustrating the simulated near-end crosstalk in the forward direction of a pin connector that includes the conductive pin array illustrated in FIG. 9A.

FIG. 10 is a graph illustrating the simulated near-end crosstalk performance in the forward direction for each of the pair combinations of the conductive pin array 124 of FIG. 9. In FIG. 10, curve 190 illustrates the near-end crosstalk performance between pairs 141 and 142, curve 191 illustrates the near-end crosstalk performance between pairs 141 and 143, curve 192 illustrates the near-end crosstalk performance between pairs 141 and 144, curve 193 illustrates the near-end crosstalk performance between pairs 142 and 143, curve 194 illustrates the near-end crosstalk performance between pairs 142 and 144, curve 195 illustrates the near-end crosstalk performance between pairs 143 and 144, and curves 198 and 199 illustrate the near-end crosstalk limits under the TIA and ISO versions of the Category 6A standard, respectively.

As shown in FIG. 10, the simulated near-end crosstalk in the forward direction between adjacent differential pairs (namely curves 190, 193 and 195) is at least 5 dB better than the level of crosstalk allowed under the TIA and ISO Category 6A standards. This represents about a 17 dB improvement in crosstalk performance as compared to the crosstalk performance illustrated in FIG. 7 for the conventional pin connector 10. The simulated near-end crosstalk in the forward direction between "one-over" differential pair combinations (namely curves 191 and 194) is at least 7 dB better than the level of crosstalk allowed under the TIA and ISO Category 6A standards. Finally, the simulated near-end crosstalk in the forward direction between the two-over differential pair combination (namely curve 192) is at least 13 dB better than the level of crosstalk allowed under the TIA and ISO Category 6A standards. Thus, FIG. 10 illustrates that the pin connector 100 according to embodiments of the present invention may provide significantly enhanced crosstalk performance as compared to a conventional pin connector 10.

Figure 11:
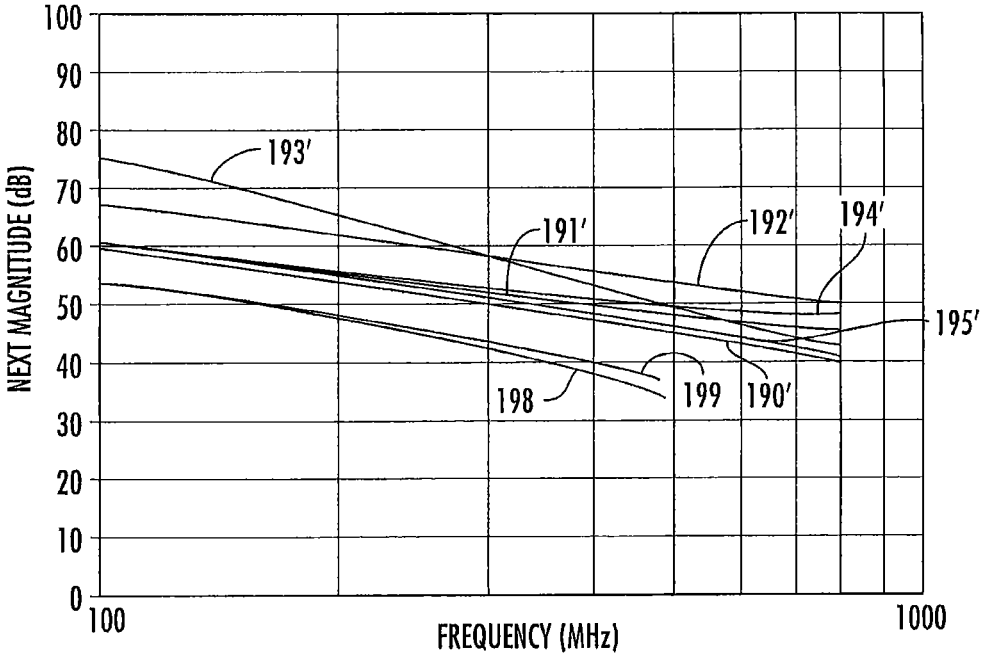
FIG. 11 is a graph illustrating the simulated near-end crosstalk in the reverse direction of a pin connector that includes the conductive pin array illustrated in FIG. 9A.

FIG. 11 is a graph illustrating the simulated reverse near end crosstalk performance for each of the pair combinations of the pin connector 100 of FIGS. 8-9. In FIG. 11, curve 190' illustrates the near-end crosstalk performance between pairs 141 and 142, curve 191' illustrates the near-end crosstalk performance between pairs 141 and 143, curve 192' illustrates the near-end crosstalk performance between pairs 141 and 144, curve 193' illustrates the near-end crosstalk performance between pairs 142 and 143, curve 194' illustrates the near-end crosstalk performance between pairs 142 and 144, curve 195' illustrates the near-end crosstalk performance between pairs 143 and 144, and curves 198 and 199 illustrates the near-end crosstalk limits under the TIA and ISO versions of the Category 6A standard, respectively. As shown in FIG. 11, the simulated near-end crosstalk in the reverse direction is quite similar to the simulated cross-talk performance in the forward direction, and all pair combinations have significant margin with respect to meeting the TIA and ISO Category 6A standards. Simulations also indicate that all pair combinations have significant margin with respect to meeting the TIA and ISO Category 6A standards for far-end crosstalk performance, although the results of these simulations are not provided herein for purposes of brevity.

Another potential advantage of the conductive pin arrangement of FIG. 9A is that the structure may also be self-compensating for differential-to-common mode crosstalk. In particular, differential-to-common mode crosstalk refers to crosstalk that arises where the two conductors of a differential pair, when excited differentially, couple unequal amounts of energy on both conductors of another differential pair when the two conductors of the victim differential pair are viewed as being the equivalent of a single conductor. However, because the conductive pins 130 of each of the differential pairs 141-144 include a crossover, the conductive pin arrangement employed in pin connector 100 also self-compensates for differential-to-common mode crosstalk. This can be seen, for example, by analyzing pairs 141 and 142. When the conductive pins 130-1 and 130-2 of pair 141 are excited differentially (i.e., carry a differential signal), in the front end of the conductive pin array 124, conductive pin 130-2 will induce a higher amount of crosstalk onto pair 142 (i.e., onto conductive pins 130-3 and 130-4 viewed as a single conductor) than will conductive pin 130-1, thereby generating an offending differential-to-common mode crosstalk signal. However, at the rear end of the conductive pin array, conductive pin 130-1 will induce a higher amount of crosstalk onto pair 142 (i.e., onto conductive pins 130-3 and 130-4 viewed as a single conductor) than will conductive pin 130-2 due to the crossover of the conductive pins of pair 141, thereby generating a compensating differential-to-common mode crosstalk signal that may cancel much of the offending differential-to-common mode crosstalk signal. This same effect will occur on all of the other pair combinations.

Figure 2:
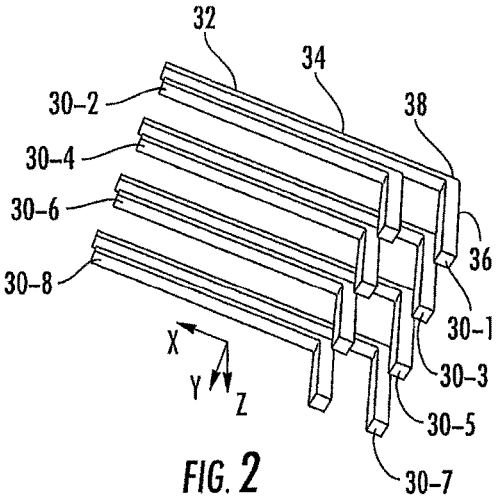
FIG. 2 (PRIOR ART)
FIG. 2 is a schematic perspective view illustrating eight of the conductive pins included in the pin connector of FIG. 1.
Figure 3:
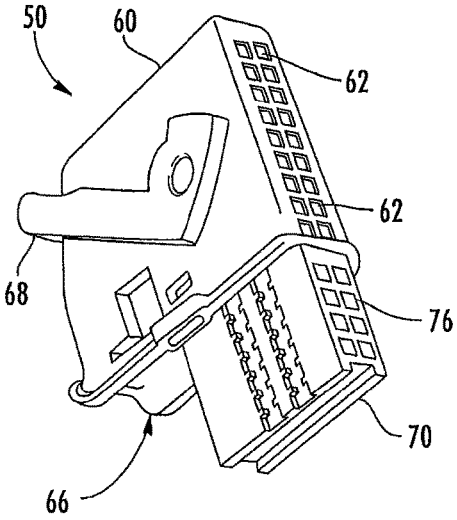
FIG. 3 (PRIOR ART)
FIG. 3 is a front, side perspective view of a conventional socket connector in a partially disassembled state.
Figure 4:
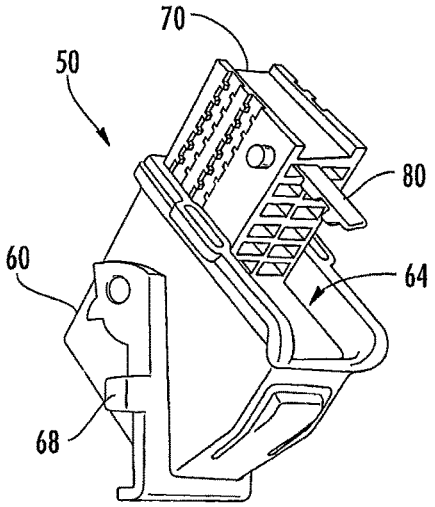
FIG. 4 (PRIOR ART)
FIG. 4 is a bottom, rear perspective view of the socket connector of FIG. 3.
Figure 5:
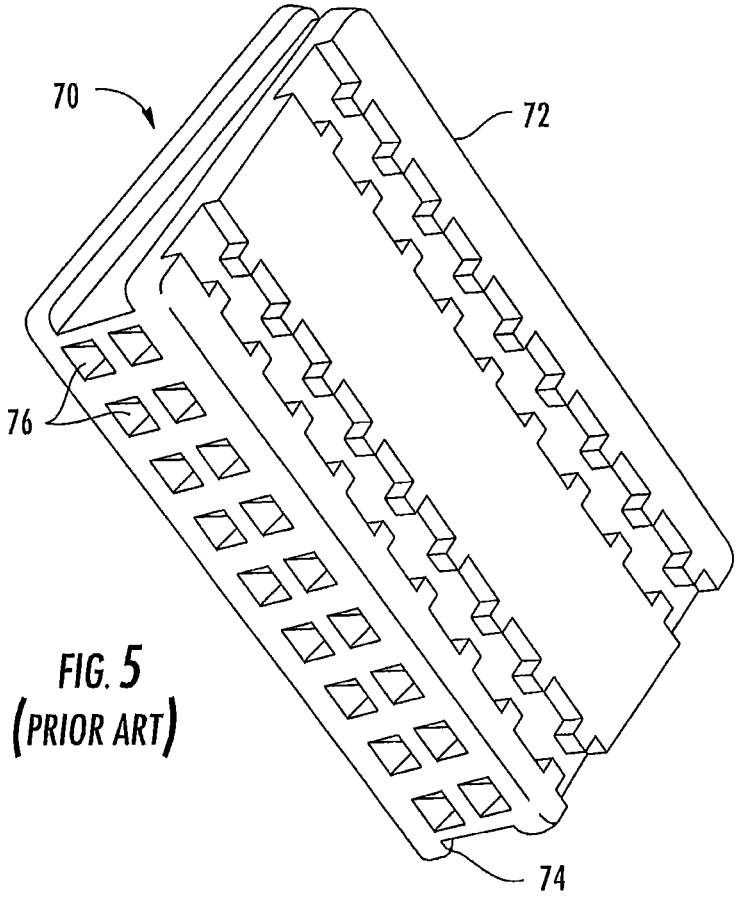
FIG. 5 (PRIOR ART)
FIG. 5 is a perspective view of a socket array that is included in the socket connector of FIGS. 3-4.

Additionally, balancing the tip and ring conductors of a differential pair may be important for other electrical performance parameters such as minimizing emissions of and susceptibility to electromagnetic interference (EMI). In pin connector 100, each differential pair may be well-balanced as the tip and ring conductive pins may be generally of equal lengths. In contrast, the tip conductive pins in the pin connector 10 of FIGS. 1-2 are clearly longer than the ring conductive pins, which may negatively impact their EMI performance.

Figure 12:
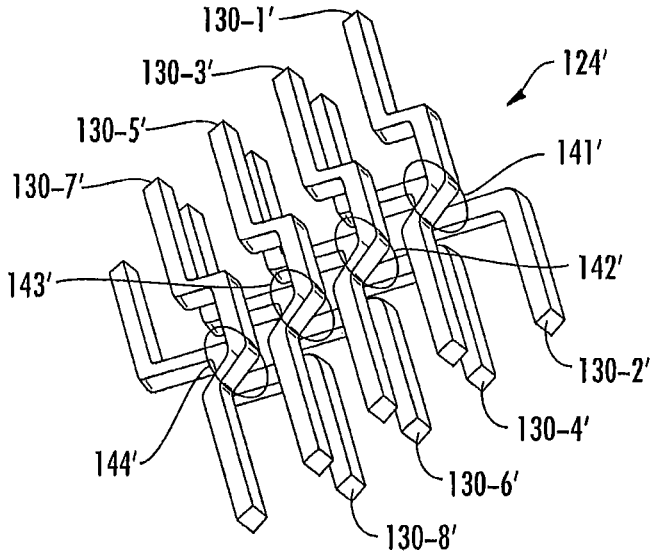
FIG. 12 is a schematic perspective view of a conductive pin array of a pin connector according to further embodiments of the present invention.

FIG. 12 is a perspective view of a conductive pin array 124' of a pin connector according to further embodiments of the present invention. As shown in FIG. 12, the conductive pin array 124' includes eight conductive pins 132-1 through 132-8 that are arranged as four differential pairs of conductive pins 141'-144'. The conductive pin array 124' is quite similar to the conductive pin array 124 of pin connector 100 that is illustrated in FIGS. 9A-9D, except that the conductive pins 132-1 through 132-8 in the embodiment of FIG. 12 do not include the right angle bend 138. Pin connectors that use the conductive pin array 124' of FIG. 12 may be more suitable for use in an inline connector that connects two communications cables, while pin connectors that use the conductive pin array 124 of FIGS. 9A-9D may be more suitable for connecting a communications cable to, for example, a printed circuit board.

Figure 6:
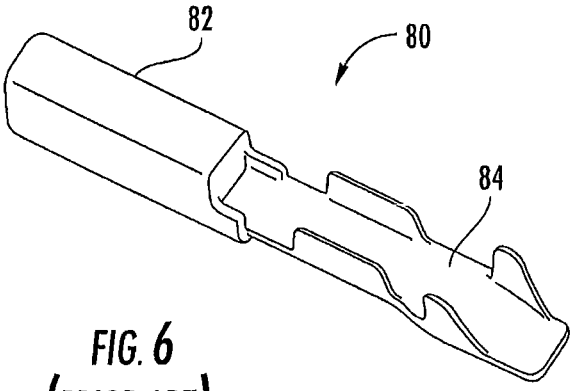
FIG. 6 (PRIOR ART)
FIG. 6 is a schematic perspective view of one of the socket contacts that is included in the socket array of FIG. 5.
Figure 13:
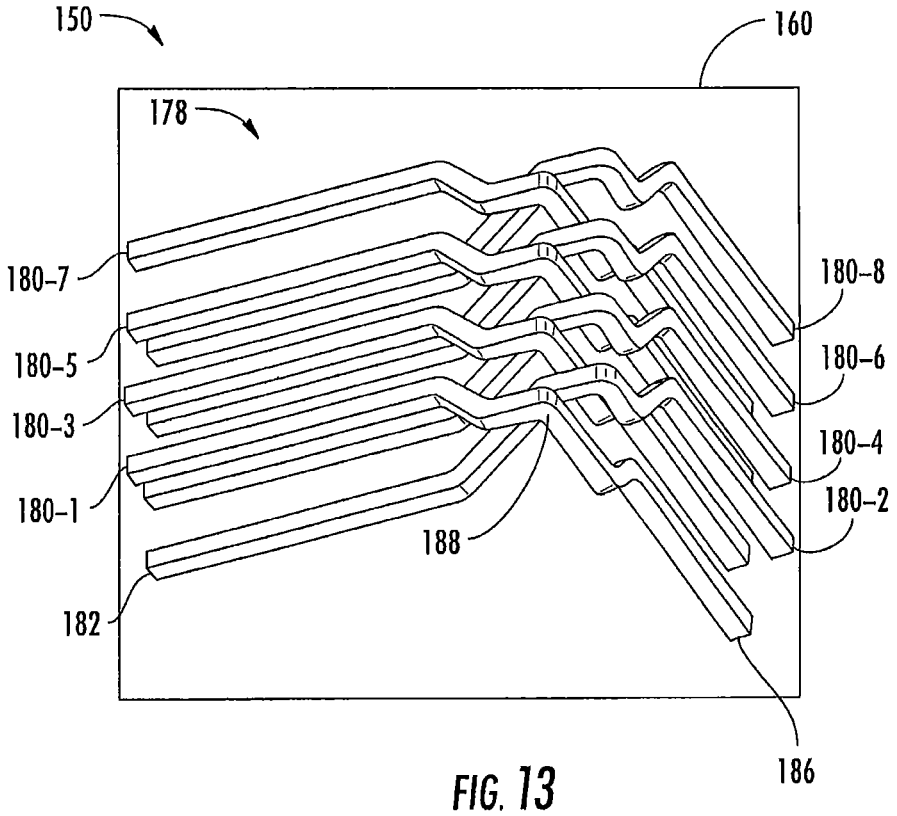
FIG. 13 is a schematic diagram illustrating a socket contact array of a socket connector according to embodiments of the present invention.

It will likewise be appreciated that the concepts discussed above with respect to pin connectors may also be applied to socket connectors to improve the electrical performance of such connectors. By way of example, the aforementioned FIG. 6 is an enlarged perspective view of a conventional socket contact 80. Pursuant to embodiments of the present invention, socket connectors may be provided which include socket contacts similar to the socket contact 80 illustrated in FIG. 6, except that each socket contact included in the socket connector is bent to, for example, have the same general shape as the conductive pins in the conductive pin array 124 of pin connector 100. FIG. 13 schematically illustrates such a socket connector 150 according to embodiments of the present invention. The socket connector 150 includes a socket contact array 178 that includes eight socket contacts 180-1 through 180-8. In order to simplify the drawing, each socket contact 180 in the socket contact array 178 is illustrated as a metal wire, and the housing 160 of the connector is indicated by a simple box. By controlling various parameters including the spacing between the socket contacts 180, the lengths of the front ends and rear ends of the socket contacts 180, the amount of facing surface area between adjacent socket contacts 180 in the socket contact array 178, etc., the socket contact array 178 of FIG. 13 may be designed to substantially cancel both differential-to-differential and differential-to-common mode crosstalk. While the socket contact array 178 of FIG. 13 includes a right angle 188 in each socket contact 180, it will be appreciated that in other embodiments the socket contact array 178 may instead omit the right angles so as to correspond to the conductive pin array design of FIG. 12.

In some embodiments, the socket connector 150 of FIG. 13 may be implemented so that the first ends 182 of each socket contact 180 may comprise a pin receiving cavity that may have the form of the first end 82 of the socket contact 80 depicted in FIG. 6 above. The second ends 186 of each socket contact 180 may comprise a pin that is suitable for mounting in a metal-plated aperture in a printed circuit board. Such embodiments may be particularly well-suited for providing a printed circuit board mounted socket connector. However, it will be appreciated that numerous other embodiments are possible. For example, in other embodiments, both the first ends 182 and the second ends 186 of each socket contact 180 may comprise a pin receiving cavity that may have the form of the first end 82 of the socket contact 80 depicted in FIG. 6 above so that each socket contact 180 comprises a double-sided socket contact. In still other embodiments, the first end 182 of each socket contact 180 may comprise a pin receiving cavity while the second end 86 of each socket contact 180 may comprise a wire-crimp contact similar to the second end 84 of the socket contact 80 depicted in FIG. 6 above. Still other embodiments may be provided by reversing the first ends 182 and the second ends 186 of each socket contact 180 in the above-described embodiment (e.g., the first embodiment described above could be modified so that the second ends 186 of each socket contact 180 comprise a pin receiving cavity and the first ends 182 of each socket contact 180 comprise a pin that is suitable for mounting in a metal-plated aperture in a printed circuit board). It will likewise be appreciated that the socket contacts 180 need not all have the same configuration (e.g., some socket contacts 180 could have a first end 182 that is implemented as a pin receiving cavity while other of the socket contacts 180 could have a first end 182 that is implemented as a pin that is suitable for mounting in a metal-plated aperture in a printed circuit board).

The socket contacts and pin contacts according to embodiments of the present invention may be mated together to provide mated pin and socket connectors. As discussed above, by designing both the pin connector and the socket connector to employ crosstalk compensation, it is possible to provide mated pin and socket connectors that may support very high data rates such as the data rates supported by the Ethernet Category 6A standards. However, it will also be appreciated in light of the present disclosure that another way of achieving such performance is to provide a pin and socket connector which when mated together act as one integrated physical structure that enables a low crosstalk mated pin and socket connector.

In particular, in the above-described embodiments of the present invention, the conductive pin array of the pin connector includes both staggers and crossovers as crosstalk reduction techniques so that the amount of uncompensated crosstalk that is generated in these pin connectors may be very low. Likewise, the socket contact array of the socket connectors include both staggers and crossovers as crosstalk reduction techniques so that the amount of uncompensated crosstalk that is generated in these socket connectors may also be very low. Thus, in the mated pin and socket connectors that are formed using the above-described pin and socket connectors, each conductive path through the mated connectors includes multiple staggers and crossovers.

Pursuant to further embodiments of the present invention, the combination of a pin connector that is mated with a socket connector may be viewed as a single connector that employs the crosstalk compensation techniques according to embodiments of the present invention. Two such mated pin and socket connectors are schematically illustrated in FIGS. 14A and 14B.

Figure 14A:
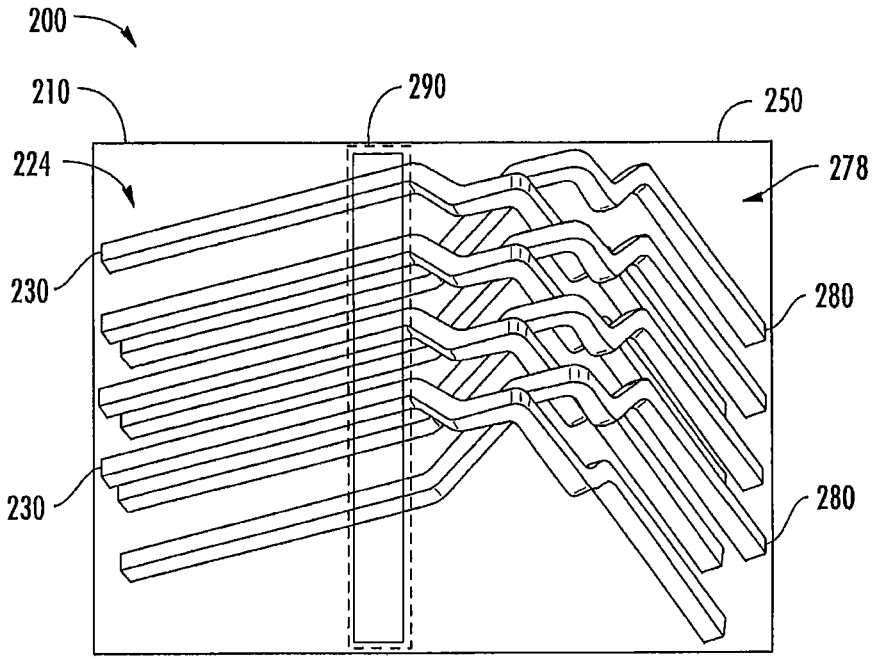
FIGS. 14A and 14B are schematic diagrams of pin connectors according to embodiments of the present invention mated with socket connectors according to embodiments of the present invention to provide a mated pin-socket connectors.

In particular, FIG. 14A schematically illustrates a mated pin and socket connector 200 that includes a pin connector 210 and a socket connector 250. As shown in FIG. 14A, the pin connector 210 may include a conductive pin array 224 that includes a plurality of straight conductive pins 230. The socket connector 250 may include a socket contact array 278 that includes a plurality of socket contacts 280. As shown in FIG. 14A, each socket contact 280 may be bent to have a right angle bend and may also be bent so that it crosses over or under the another socket contact 280. Consequently, the combination of each tip conductive pin 230 and its mating tip socket contact 280 may be designed to have the same shape as the tip conductive pins 130-1, 130-3, 130-5, 130-7 of FIGS. 9A-9D, and the combination of each ring conductive pin 230 and its mating socket contact 280 may be designed to have the same shape as the ring conductive pins 130-2, 130-4, 130-6, 130-8 of FIGS. 9A-9D. The shape, size and relative locations of the conductive pins 230 and the socket contacts 280 may be adjusted so that while the differential-to-differential crosstalk at the pin or socket end of the connector self cancels due to their staggered arrangement at either end, the differential-to-common mode pair-to-pair crosstalk that is generated on one side of the crossovers is substantially cancelled by opposite polarity differential-to-common mode pair-to-pair crosstalk that is generated on the opposite side of the crossovers. Note that when the pin connector 210 is mated with the socket connector 250 a mating region 290 is formed where the conductive pins 230 of the pin connector 210 are received within their respective socket contacts 280 of the socket connector 250. It will be appreciated that each conductive pin 230 may comprise a conductive pin on one end (namely the end that is received within a socket contact 280) while the other end of each conductive pin 230 may have any suitable contact structure such as a wire-crimp connection, a conductive pin, etc. It will similarly be appreciated that each socket contact 280 may comprise a pin receiving cavity on one end (namely the end that receives the conductive pin 230) while the other end of each socket contact 280 may have any suitable contact structure such as a wire-crimp connection, a conductive pin, etc.

Figure 14B:
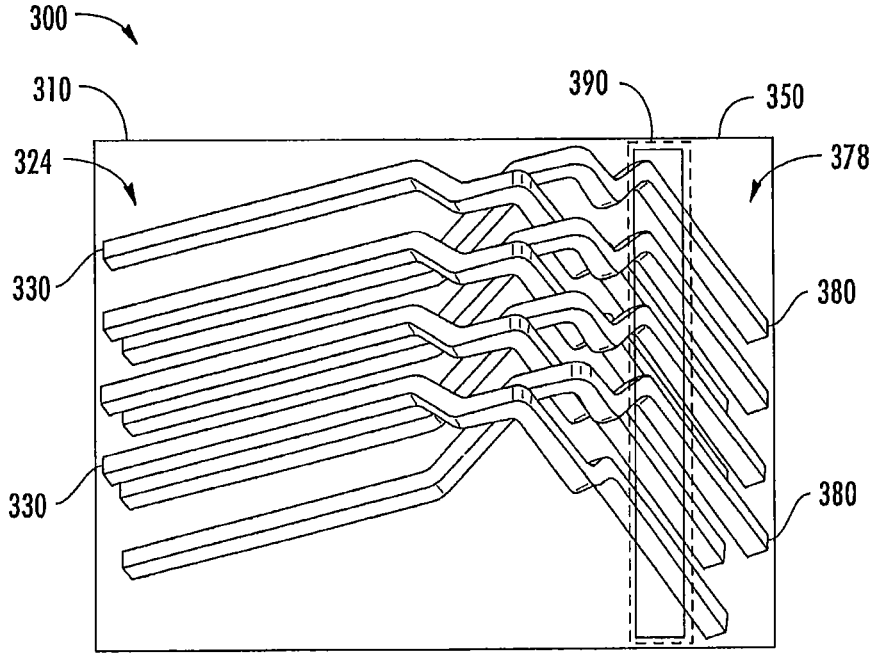

As shown in FIG. 14B, in another example embodiment, a mated pin and socket connector 300 that includes a pin connector 310 and a socket connector 350 is provided. The pin connector 310 may include a conductive pin array 324 that includes a plurality of conductive pins 330. Each of the conductive pins 330 may have the general design of the conductive pins 130 of pin connector 100. The socket connector 350 may include a socket contact array 378 that includes a plurality of socket contacts 380 that may have the design of socket contact 80 of FIG. 6. The combination of each tip conductive pin 330 and its mating tip socket contact 380 may be designed to have the same shape as the tip conductive pins 130-1, 130-3, 130-5, 130-7 of FIGS. 9A-9C, and the combination of each ring conductive pin 330 and its mating socket contact 380 may be designed to have the same shape as the ring conductive pins 130-2, 130-4, 130-6, 130-8 of FIGS. 9A-9C. The shape, size and relative locations of the conductive pins 330 and the socket contacts 380 may be adjusted so that while the differential-to-differential crosstalk at the pin or socket end of the connector self cancels due to their staggered arrangement at either end, the differential-to-common mode pair-to-pair crosstalk that is generated on one side of the crossovers is substantially cancelled by the opposite polarity differential-to-common mode pair-to-pair crosstalk that is generated on the opposite side of the crossovers. Note that when the pin connector 310 is mated with the socket connector 350 a mating region 390 is formed where the conductive pins 330 of the pin connector 310 are received within their respective socket contacts 380 of the socket connector 350.

Figure 22:
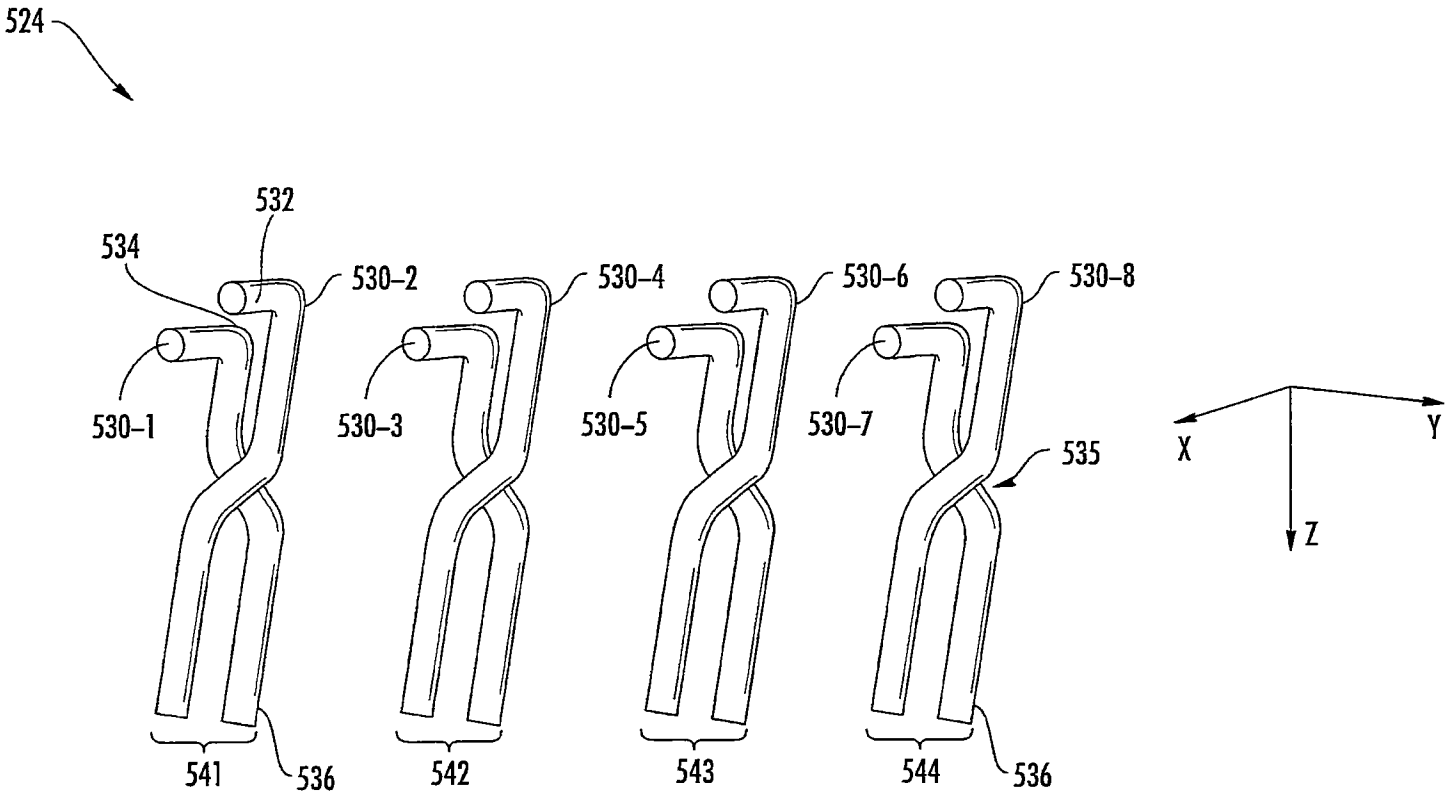
FIG. 22 is a perspective view of the pin arrangement of a pin connector according to still further embodiments of the present invention.

FIG. 22 is a schematic bottom perspective view of the conductive pins 530-1 through 530-8 that form the conductive pin array 524 of a pin connector according to further embodiments of the present invention. The conductive pin array 524 may be used, for example, in the connector 100 of FIG. 8. To implement the connector 100 of FIG. 8 using the conductive pin array 524, the conductive pin array 524 could be expanded to include 18 pins or, alternatively, the connector 100 could be designed to only include a total of eight pins 530. It will also be appreciated that the connector 100 could be designed to include any even number of pins 530.

As shown in FIG. 22, pins 530-1 and 530-2 form a first differential pair 541, pins 530-3 and 530-4 form a second differential pair 542, pins 530-5 and 530-6 form a third differential pair 543, and pins 530-7 and 530-8 form a fourth differential pair 544. In the depicted embodiment, conductive pins 530-1, 530-3, 530-5 and 530-7 may be the tip conductive pins and conductive pins 530-2, 530-4, 530-6 and 530-8 may be the ring conductive pins of the four differential pairs 541-544.

As is further shown in FIG. 22, each conductive pin 530 includes a first end portion 532, a middle portion 534, and a second end portion 536. The first end portion 532 of each conductive pin 530 generally extends along the x-direction. The second end portion 536 of each conductive pin 530 generally extends along the z-axis. The middle portion 534 of each conductive pin 530 comprises a right angled section that provides the transition from the x-direction to the z-direction. Additionally, the second end portion 536 of each conductive pin 530 further includes two jogged sections that are provided so that the tip conductive pin of each differential pair of conductive pins 541-544 crosses over the ring conductive pin of the differential pair of conductive pins 541-544 at a crossover location 535. Note that any appropriate jogged sections may be used that implement the crossovers of the tip and ring conductive pins of each differential pair 541-544.

As shown in FIG. 22, the first ends 532 of the conductive pins 530 are aligned in two rows and the second ends 536 are similarly aligned in two rows. The staggered arrangement of the conductive pins as well as the crossovers implemented in each differential pair 541-544 may be designed to reduce or minimize crosstalk between adjacent differential pairs 541-544. The same crosstalk compensation benefits may also be achieved with respect to crosstalk between non-adjacent pairs such as "one-over" combinations of differential pairs, "two-over" combinations of differential pairs, etc. Moreover, the crosstalk compensation arrangement that is implemented in the conductive pin arrangement of FIG. 22 is "stackable" in that any number of additional differential pairs of conductive pins 530 can be added to the first and second rows.

It will be appreciated that numerous modifications may be made to the example pin and socket connectors pictured in the drawings without departing from the scope of the present invention. As one example, the pin connectors discussed above have a plug aperture (and hence are "jacks") while the socket connectors are received within the plug aperture (and hence are "plugs"). In other embodiments, the socket connectors may have a plug aperture that the pin connectors are received within such that the socket connectors are jacks and the pin connectors are plugs. Moreover, as discussed above with respect to some of the embodiments, each contact structure of the connectors according to embodiments of the present invention may be implemented as any suitable combination of the contact structures described herein (e.g., both ends of a particular contact structure may comprise conductive pins, one end may comprise a conductive pin and the other end may comprise a wire-termination contact such as a crimped connection, one end may comprise a conductive pin and the other end may comprise a pin receiving cavity, both ends may comprise pin-receiving cavities, etc.).

As another example, the pin and socket connectors discussed above either have straight conductive pins/socket contacts or conductive pins/socket contacts that include a 90° angle. It will be appreciated that in other embodiments any appropriate angle, curve, series of angles or the like may be included in either the conductive pins or the socket contacts. It will similarly be appreciated that the pin and socket connectors may include any number of conductive pins/sockets, and that the pins/sockets may be aligned in more than two rows in other embodiments.

Pursuant to further embodiments of the present invention, cable systems for high-speed automotive local area networks are provided that use twisted pair cabling.

Modern vehicles include a plethora of communication devices, such as Global Positioning Systems (GPS); vehicle location transponders to indicate the position of the vehicle to a remote station; personal and virtual assistance services for vehicle operators (e.g., the ON STAR® service); a WiFi Internet connection area within the vehicle; one or more rear passenger DVD players and/or gaming systems; backup and side view cameras; blue tooth connections for cell phone connections and portable music players (e.g., an IPOD® device); and proximity sensors and braking, acceleration and steering controllers for backing up, parallel parking, accident avoidance and self-driving vehicles. Such communication devices are often hardwired to one or more head unit devices, which include microprocessors, memory and media readers to facilitate system updates and reprogramming for advanced features.

Because of the number of, and technically advanced features of, the communication devices, the various hardwired connections between the communications devices and the one or more head units need to accommodate high-speed data signals. Therefore, there exists a need in the art for a cabling system for establishing a high-speed local area network ("LAN") in a vehicle environment.

Thus, pursuant to further embodiments of the present invention, cabling systems for establishing a high-speed local area network in a vehicle environment are provided. These cabling systems allow for several coupling points between extended lengths of the cables, while still maintaining the high speed performance of the cabling system. The cabling system may withstand the rigors of a rugged environment. For example, vehicles are typically subjected to vibration, acceleration, and jerk, as well as, rapid temperature and humidity changes.

The high-speed connectorized cables that can be used in embodiments of the present invention have various similarities to the cable illustrated in the U.S. Pat. No. 7,999,184 ("the '184 patent"), which is incorporated herein by reference. While the cable illustrated in FIGS. 3, 4, 9 and 10 of the '184 patent includes four twisted pairs of insulated conductors, more or fewer twisted pairs could be used in the connectorized cables described herein. For example, FIG. 15 illustrates a first cable 400 that includes a single twisted pair 402 and a second cable 410 that includes first and second twisted pairs 412, 414 that are be divided by a separator 416.

Figure 15:
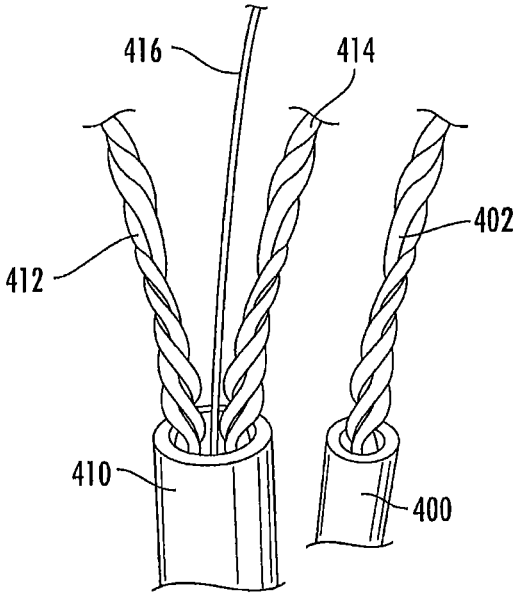
FIG. 15 is a partially cut-away perspective view of a first cable that includes a single twisted pair of insulated conductors and of a second cable that includes two twisted pairs of insulated conductors.
Figure 16:
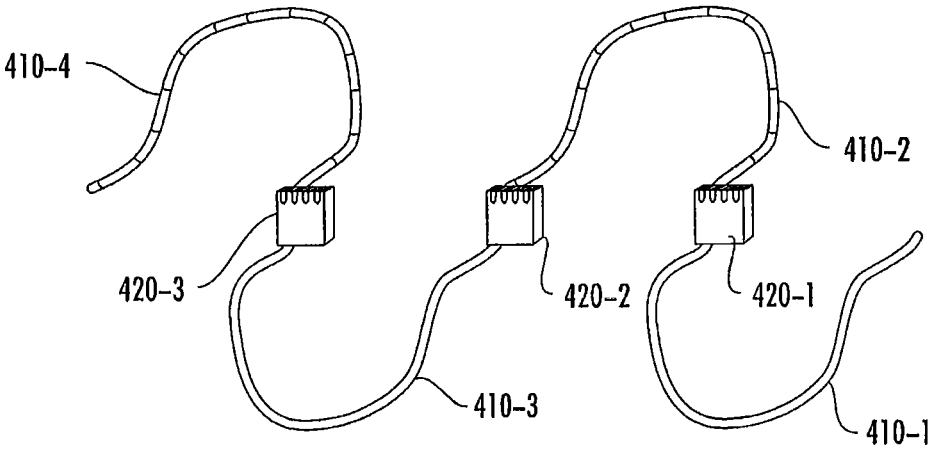
FIG. 16 is schematic block diagram illustrating an example end-to-end communications connection in a vehicle environment.

As noted above, in the vehicle environment, high speed cable such as the cables 400, 410 shown in FIG. 15, may need to be terminated and coupled to a further length of high speed cable multiple times within the vehicle. For example, as shown in FIG. 16, a connection hub 420-1 could be located proximate the rear of the vehicle (e.g., behind a rear seat or between a truck compartment and a passenger compartment). A second connection hub 420-2 could be located in a mid-section of a vehicle (e.g., in a roof liner and/or proximate an overhead entertainment center), and a third connection hub 420-3 could be located toward a front of the vehicle (e.g., beneath a dash and/or at a firewall of the engine compartment). In the vehicle environment, it is envisioned that the typical length of the cabling system from end to end would be about 15 meters or less for a passenger vehicle (e.g., car, truck or van) and about 40 meters or less for a commercial sized vehicle (e.g., bus, RV, tractor trailer).

The system preferably delivers high speed data, with an acceptably low data error rate, from the first end of the vehicle's cabling system, through the multiple connection hubs 420 to the second end of the vehicle's cabling system. Although FIG. 16 illustrates three connection hubs 420, it is envisioned that up to four or five connection hubs 420 could be present, and as little as one or two connection hubs 420 could be present.

Figure 17:
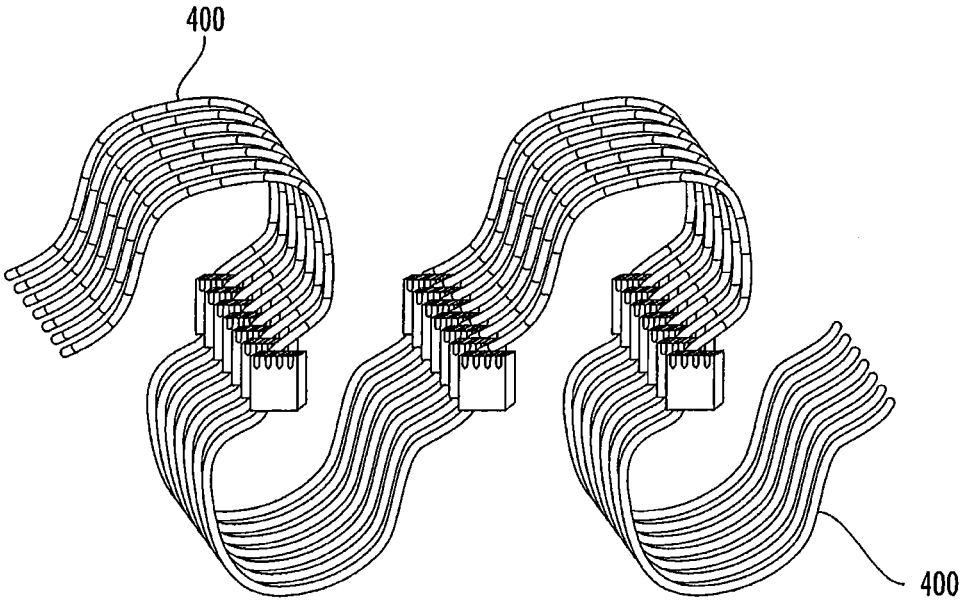
FIG. 17 is schematic block diagram illustrating how a plurality of the end-to-end communications connections of FIG. 16 may be grouped together in the vehicle environment.

As is further shown in FIG. 16, the cable system includes a first cable 410-1, with a length of about two meters, and that includes two twisted pairs 412, 414, which enters connection hub 420-1 gets connected there to a second cable 410-2, with a length of about two meters, which also includes two twisted pairs 412, 414. The second cable 410-2 passes to connection hub 420-2 where it is connected there to a third cable 410-3, with a length of about two meters, which likewise includes two twisted pairs 412, 414. The third cable passes to connection hub 420-3 where it is connected to a fourth cable 410-4, with a length of about 2 meters, which also includes two twisted pairs 412, 414. In practice, multiple cables would often be routed between the various connection hubs 420 as shown in FIG. 17, which graphically illustrates seven single-twisted pair cables 400 being routed together through the vehicle. As shown in FIG. 17, a plurality of connection hubs 420-1, 420-2, 420-3 may be provided at each connection point or, alternatively (as shown in FIG. 18), the connection hubs 420-1, 420-2, 420-3 may be replaced with larger connection hubs 420' that include connection points for multiple cables.

Figure 18:
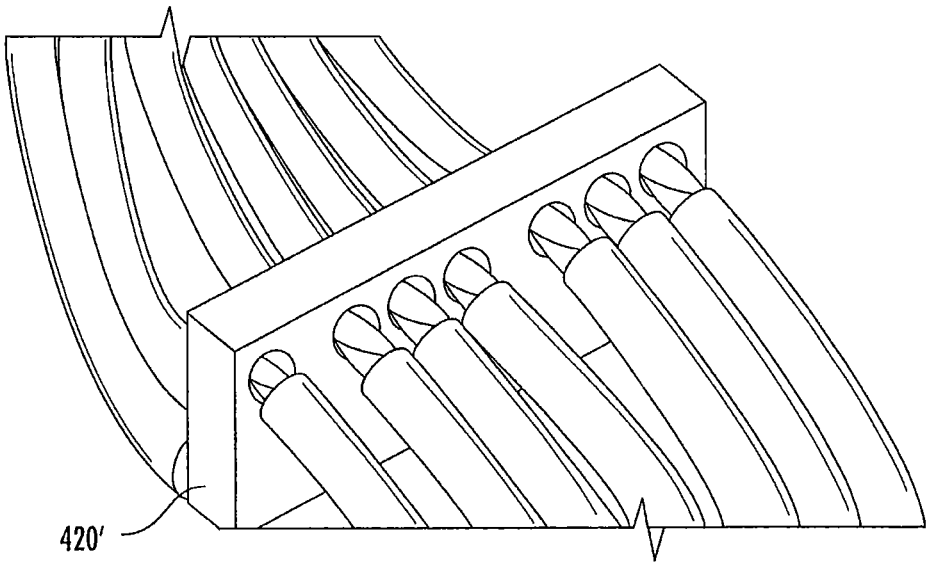
FIG. 18 is perspective view of one of the connection hubs of FIG. 17.

FIG. 18 shows the details of the connection at the middle connection hubs 420', which may be the same or similar to the connection details at the other connection hubs. In some embodiments, the connection hubs 420' may be constructed similarly to the terminal blocks described in the U.S. Pat. Nos. 7,223,115; 7,322,847; 7,503,798 and 7,559,789, each of which is herein incorporated by reference. Of course, the terminal blocks of the above-referenced patents can be modified, e.g., shortened if fewer twisted wire pairs are to be employed in the vehicle's cabling system.

As best described in the above-referenced patents, the terminal blocks include insulation displacement contacts (IDCs) that cross over within the plastic housing of the terminal blocks. The cross over points, within the terminal block, help to reduce the introduction of crosstalk to the signals, as the signals traverse through the terminal block.

In the vehicle environment, the external electro-magnetic interference (EMI) is particularly problematic due to the electrical system of the engine, which might include spark plugs, distributors, alternators, rectifiers, etc., which may be prone to producing high levels of EMI. The terminal block performs well to reduce the influence of EMI on the signals passing through the terminal blocks at the connection hubs 420.

Figure 19:
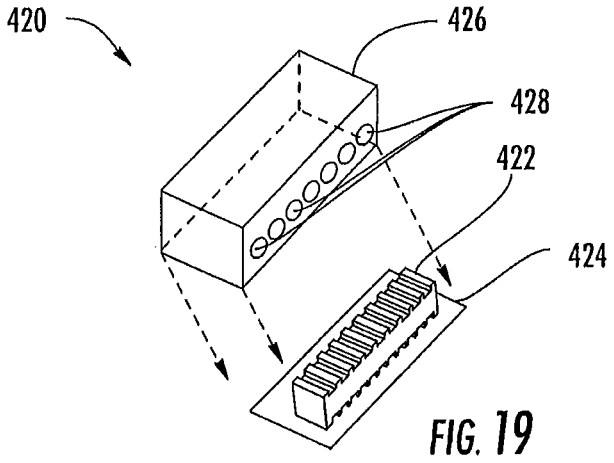
FIG. 19 is schematic exploded perspective view of the connection hub of FIG. 18.

As shown in FIG. 19, in the vehicle embodiment, the connection hubs 420 could be ruggedized. For example, the terminal block 422 of the connection hub 420 could be secured to a plastic base 424 and a cover 426 could be placed over the terminal block 422 and secured/sealed to the base 424. The cables 400, 410 could enter and exit the connection hub 420 via grommets 428, such that the terminal block 422 is substantially sealed from moisture, dust and debris in the vehicle environment. In one embodiment, the cover 426 could be transparent to allow inspection of the wire connections within the terminal block 422 without removing the cover 426.

Figure 20:
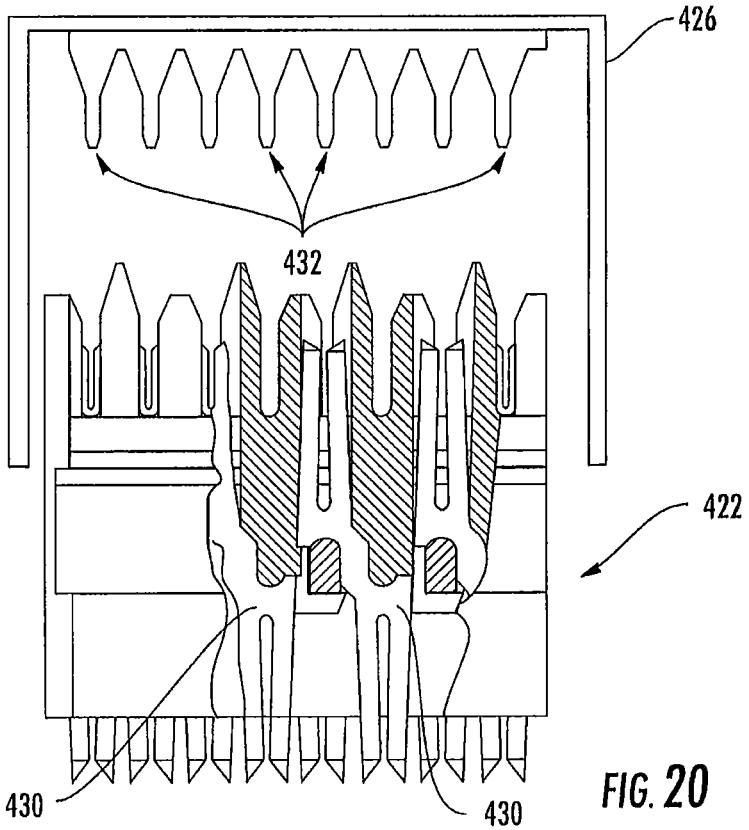
FIG. 20 is a partially cut-away front view of the connection hub of FIG. 19.

FIG. 20 is a partially cut away front view of the connection hub 420 of FIG. 19. As shown in FIG. 20, stabilizers 432 may be extend downwardly from the top of the cover 426. The stabilizers 432 extend toward the IDCs 430 of the terminal block 422, enter into the IDC channels, and may apply pressure to the wires of the twisted pairs of cables 400, 410 (not shown in FIG. 20) that are seated in the IDCs 430. In the vehicle environment, vibration might act to loosen the wires in the IDCs 430 and allow the wires to work free and break electrical contact with the IDCs 430. The stabilizers 432 could engage the wires and hold the wires in good electrical contact within the IDCs 430, or act as lids or stops to prevent the wires from leaving the IDCs 430. Thus, the stabilizers 432 may improve the vibration performance of the connection hub 420 and make it more rugged for the vehicle environment.

Figure 21:
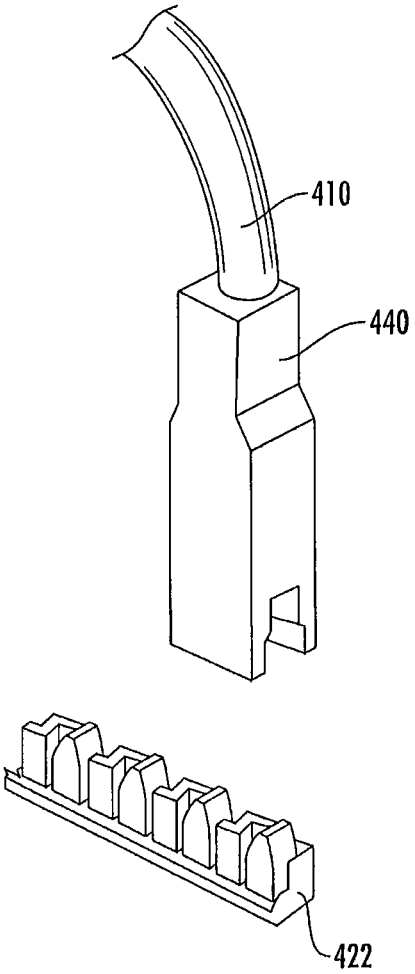
FIG. 21 is schematic perspective view illustrating how the cables that connect to the connection hubs of FIGS. 17-20 may be connectorized.

As shown in FIG. 21, in yet a further embodiment, the cable 410 that supplies the twisted pair wires 412, 414 to the IDCs 430 of the terminal block 422 may be terminated to a connector 440. The connector 440 may be snap locked onto the top of the terminal block 422, while electrical contacts within the connector 440 may electrically engage the IDCs 430 of the terminal block 422. By this arrangement, the wires of the twisted pair of the cable 410 are electrically connected to the IDCs 430 and the IDCs 430 transmit the signals of the twisted pairs 412, 414 to the twisted pairs of a second cable (not shown) that is electrically connected to the bottoms of the IDCs 430 in accordance with U.S. Pat. Nos. 7,223,115; 7,322,847; 7,503,798 and 7,559,789.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications connector system, comprising:

a housing having one pair of conductive pins mounted therein, the one pair of conductive pins arranged as a differential pair of conductive pins that includes a tip conductive pin and a ring conductive pin, wherein each conductive pin has a first end that is configured to be received within a respective socket of a mating connector and a second end, wherein the tip conductive pin of the pair of conductive pins crosses over the ring conductive pin to form a tip-ring crossover location, wherein the first end of the tip conductive pin and the first end of the ring conductive pin extend along a first axis, wherein the first end of the ring conductive pin is offset from the first end of the tip conductive pin along a second axis that is normal to the first axis, and wherein the crossover location for the pair of conductive pins is between the right angled sections of the tip and ring conductive pins.

2. The communications connector system of claim 1, wherein the housing is configured to mate with a housing of a mating connector, wherein the mating connector includes one pair of sockets.

3. The communications connector system of claim 1, wherein each of the conductive pins has substantially the same length.

4. The communications connector system of claim 1, wherein a middle portion of the tip conductive pin and a middle portion of the ring conductive pin comprises a right angled section that transitions from the second axis to a third axis that is normal to the second axis.

5. A communications connector, comprising:

a housing; and one differential pair of contacts mounted in the housing, the differential pair including a tip contact and a ring contact, wherein each contact has a first end section, a second end section, and a middle portion that is between the first and second end section, wherein each contact further has a first jogged section that is between the first end section and the middle portion and a second jogged section that is between the middle portion and the second end section, wherein the first jogged section of the tip contact jogs in a positive direction along a first direction from the middle section and the first jogged section of the ring contact jogs in a negative direction along the first direction from the middle section, wherein the second jogged section of each contact jogs in the negative direction along the first direction, and wherein the middle portion of each contact includes a right angled section where the contact extends through a right angle.

6. The communications connector of claim 5, wherein each first jogged section comprises a bend in the respective contact through an angle that is less than ninety degrees.

7. The communications connector of claim 5, wherein each second jogged section comprises a bend in the respective contact through an angle that is less than ninety degrees.

8. The communications connector of claim 5, wherein the first jogged section of the tip contact crosses over the first jogged section of the ring contact.

9. The communications connector of claim 5, wherein the first end section of each of the contacts is mounted in a printed circuit board.

10. A communications connector, comprising:

a housing having one differential pair of contacts mounted in the housing, the one differential pair of contacts including a tip contact and a ring contact, wherein each contact has a first end section that comprises a conductive socket that extends in a longitudinal direction that is configured to receive a respective pin contact of a mating connection along an axis of the respective pin contact that extends in the longitudinal direction, and a second end that is received in a metal-plated opening of a printed circuit board, wherein the tip contact crosses over the ring contact, wherein the first end section of the tip contact and the first end section of the ring contact extend along a first axis, wherein the first end section of the ring contact is offset from the first end section of the tip contact along a second axis that is normal to the first axis, and wherein a middle portion of the tip contact and a middle portion of the ring contact comprises a right angled section that transitions from the second axis to a third axis that is normal to the second axis.

11. The communications connector of claim 10, wherein each of the contacts has substantially the same length.

12. The communications connector system of claim 10, wherein the crossover location for the pair of contacts is between the right angled sections of the tip and ring contacts.

13. A communications connector, comprising:

a housing; and one differential pair of contacts mounted in the housing, the differential pair including a tip contact and a ring contact, wherein each contact has a first end section, a second end section, and a middle portion that is between the first and second end section, wherein each contact further has a first jogged section that is between the first end section and the middle portion and a second jogged section that is between the middle portion and the second end section, wherein the first jogged section of the tip contact jogs in a positive direction along a first direction from the middle section and the first jogged section of the ring contact jogs in a negative direction along the first direction from the middle section, wherein the second jogged section of each contact jogs in the negative direction along the first direction, and wherein each first jogged section comprises a bend in the respective contact through an angle that is less than ninety degrees.

14. The communications connector of claim 13, wherein the middle portion of each contact includes a right angled section where the contact extends through a right angle.

15. The communications connector of claim 13, wherein each second jogged section comprises a bend in the respective contact through an angle that is less than ninety degrees.

16. The communications connector of claim 13, wherein the first jogged section of the tip contact crosses over the first jogged section of the ring contact.

17. The communications connector of claim 13, wherein the first end section of each of the contacts is mounted in a printed circuit board.

18. The communications connector system of claim 1, wherein the housing has two pairs of conductive pins mounted therein.

19. The communications connector system of claim 1, wherein the housing has three pairs of conductive pins mounted therein.

20. The communications connector system of claim 1, wherein the housing has four pairs of conductive pins mounted therein.

* * * * *